US009159546B2

(12) United States Patent
Mertens

(10) Patent No.: US 9,159,546 B2
(45) Date of Patent: Oct. 13, 2015

(54) HIGH-PRESSURE GAS DISCHARGE LAMP

(71) Applicant: KONINKLIJKE PHILIPS N.V., Eindhoven (NL)

(72) Inventor: Juergen Gerhard Mertens, Aachen (DE)

(73) Assignee: Koninklijke Phillips N.V., Eindhoven (NL)

( * ) Notice: Subject to any disclaimer, the term of this patent is extended or adjusted under 35 U.S.C. 154(b) by 0 days.

(21) Appl. No.: 14/360,320

(22) PCT Filed: Nov. 26, 2012

(86) PCT No.: PCT/IB2012/056718
§ 371 (c)(1),
(2) Date: May 23, 2014

(87) PCT Pub. No.: WO2013/080112
PCT Pub. Date: Jun. 6, 2013

(65) Prior Publication Data

US 2015/0091431 A1 Apr. 2, 2015

Related U.S. Application Data

(60) Provisional application No. 61/563,892, filed on Nov. 28, 2011.

(51) Int. Cl.

| | |
|---|---|
| ***H01J 61/36*** | (2006.01) |
| ***H01J 61/52*** | (2006.01) |
| ***H01J 5/54*** | (2006.01) |
| ***H01J 9/24*** | (2006.01) |
| ***H01J 61/82*** | (2006.01) |

(52) U.S. Cl.
CPC . *H01J 61/36* (2013.01); *H01J 5/54* (2013.01); *H01J 9/24* (2013.01); *H01J 61/52* (2013.01); *H01J 61/82* (2013.01)

(58) Field of Classification Search
None
See application file for complete search history.

(56) References Cited

U.S. PATENT DOCUMENTS

| | | | | |
|---|---|---|---|---|
| 4,644,226 | A * | 2/1987 | Vernooij et al. | 315/50 |
| 6,731,076 | B1 | 5/2004 | Gerhard et al. | |
| 7,625,237 | B2 | 12/2009 | Hackenbuchner et al. | |
| 7,772,780 | B2 | 8/2010 | Pokharna et al. | |
| 2004/0066150 | A1 | 4/2004 | Neumeier et al. | |
| 2008/0157914 | A1 | 7/2008 | Pokharna | |
| 2008/0191627 | A1 | 8/2008 | Hamada et al. | |
| 2008/0309240 | A1 | 12/2008 | Goray et al. | |
| 2015/0084507 | A1 * | 3/2015 | Dabringhausen et al. | 315/105 |

FOREIGN PATENT DOCUMENTS

| | | | |
|---|---|---|---|
| DE | 19543852 | A1 | 5/1997 |
| FR | 2704937 | A1 | 11/1994 |

* cited by examiner

*Primary Examiner* — Ashok Patel
(74) *Attorney, Agent, or Firm* — Patent Law Group LLP; Brian D. Ogonowsky

(57) ABSTRACT

A high-pressure gas discharge lamp unit 10 is described including a burner 14 with a discharge vessel 18. The burner 14 comprises electrical contact leads 22,24 and protrudes from and is fixed to a lamp cap housing 12, so that at least a first of the contact leads 22, 24 extends into the housing 12. A lamp operating circuit 50 is arranged within the housing 12, electrically connected to the electrical contact leads 22, 24. In order to allow a particularly compact lamp unit, the housing comprises a bottom plate 44 made out of a metal material to dissipate heat, which comprises an opening 68 into which a cap element 60 made out of an electrically insulating material is inserted to enclose a first electrical contact lead 22.

6 Claims, 4 Drawing Sheets

HIGH-PRESSURE GAS DISCHARGE LAMP

CROSS-REFERENCE TO PRIOR APPLICATIONS

This application is the U.S. National Phase application under 35 U.S.C. §371 of International Application No. PCT/IB2012/056718, filed on Nov. 26, 2012, which claims the benefit of 61/563,892, filed on Nov. 28, 2011. These applications are hereby incorporated by reference herein.

TECHNICAL FIELD

The present invention relates to the field of high-pressure gas discharge lamps, and in particular to a high-pressure gas discharge lamp unit including a lamp operating circuit within a housing, as well as to a lamp cap housing therefor, and to a method of manufacturing a high-pressure gas discharge lamp unit.

BACKGROUND ART

High-pressure gas discharge lamps are used in a large area of applications where high luminous flux is required. Especially in the automotive field, high-pressure gas discharge lamps are used in vehicle headlights.

A discharge lamp generally comprises a sealed discharge vessel, where an electrical arc may be ignited between electrodes within a discharge space to generate light. Besides a burner, which includes the discharge vessel and electrodes, a gas discharge lamp further generally comprises a lamp cap comprising mechanical fastening elements and electrical connector means, such that the burner is mechanically fixed and electrically connected to the lamp cap, and the lamp cap itself is electrically connected and mechanically fixed e.g. in a vehicle headlight unit.

It is generally known to provide a lamp cap housing comprising an electrical circuit electrically connected to the burner.

US 2004/0066150 A1 describes a gas-discharge lamp base with an ignition device. The base comprises as three main component parts an upper housing part, a lead frame and a cover. The upper housing part has a central stub for receiving leads to the lamp burner. The lead frame is connected to the lamp burner. The lower housing part comprises a covering plate and a cylindrical, hollow, downwardly open hollow cylinder or stub, which is formed on to the plate. During assembly, the electrical conductors are welded or soldered to a printed circuit board or lead frame. The lower housing part is inserted with its stub into the upper housing part, such that the stub encloses a high voltage contact of the burner and forms a labyrinth to avoid flashovers.

SUMMARY OF THE INVENTION

It is an object of the present invention to provide a high-pressure gas discharge lamp unit, lamp cap housing, and manufacturing method allowing a particularly compact lamp unit.

This object is solved by a high-pressure gas discharge lamp unit according to claim 1, by a lamp cap housing according to claim 11, and by a method of manufacturing according to claim 12. Dependent claims refer to preferred embodiments of the invention.

According to the invention, the lamp unit comprises a burner including a discharge vessel where an electrical arc may be generated. Usually, the burner will have two electrical contact leads, such that each of two electrodes may be supplied with electrical power. A first electrical contact lead, which may also be referred to as a central contact lead, extends preferably from the discharge vessel, and is preferably at least partially guided within a burner tube extending from the discharge vessel. A second electrical contact lead, or return contact, is preferably provided in parallel to the burner and partially enclosed in a ceramic tube. Besides the discharge vessel and the electrical contact leads, the burner may comprise further a transparent outer bulb provided around the discharge vessel.

According to the invention, the burner protrudes from a lamp cap housing such that the discharge vessel is arranged at a distance from the housing. The burner is fixed to the lamp cap housing, such that at least a first of the electrical contact leads is arranged within the housing. Preferably parts of a burner, in particular a quartz tube provided around an electrical contact lead, may be arranged to extend into the housing, such as e.g. more than half and further preferred even more than two thirds of the axial length of the housing.

Within the housing, a lamp operating circuit is arranged, electrically connected to the electrical contact leads of the burner. The lamp operating circuit is an electrical circuit provided to supply electrical power to the lamp during operation. Different electrical circuits may be used, such as e.g. an ignition circuit for supplying a high voltage to the burner in order to ignite an arc and start the lamp. A corresponding ignition circuit comprises, as known per se to the skilled person, components such as a transformer, a capacitor and a sparking gap. However, according to preferred embodiments of the invention, the electrical circuit arranged within the housing does not only supply the high ignition voltage, but also comprises a driver circuit to supply electrical power to the burner during steady state operation of the lamp. In this case, the electrical circuit comprises components required for generating a lamp operating current with a desired waveform and values for electrical current, voltage and power. For example, a corresponding driver circuit may comprise semiconductor components for switching a supply voltage to obtain a desired operating voltage in a controlled manner. In particular, the driver circuit may comprise a microcontroller to control the lamp operation.

According to the invention, the housing comprises at least a bottom plate made out of a metal material in order to dissipate heat. During operation of the discharge lamp, heat is transferred to the housing from the burner. Additionally, heat is generated in the lamp operating circuit. In order to maintain a temperature, which still allows operation of the components of the lamp operating circuit, the heat transferred to or generated within the lamp cap housing should be dissipated. This may be achieved by providing at least the bottom plate of the lamp cap housing to be made of metal material, providing good heat conduction and dissipation properties, such as e.g. copper, aluminum or suitable alloys. It is further preferred that not only the bottom plate, but also further parts of the lamp cap housing may be made out of metal material, in particular one or more, preferably all side walls.

According to the invention, the metallic bottom plate comprises an opening, into which a cap element made out of an insulating material, such as preferably a plastic material, is inserted to enclose at least the first contact lead.

Thus, the invention combines reliable insulation of at least the first contact lead with effective heat dissipation, while maintaining easy assembly. Due to the insulation and heat dissipation, the lamp unit may be made very compact without increasing the risk of electrical flashover or inadmissible operating temperature. By providing an opening in the bottom plate and inserting a cap element, the lamp unit may be easily assembled.

Generally, the cap element may have any shape suitable to at least partially enclose the first contact lead. According to preferred embodiment of the invention, the cap element comprises a bottom section and at least a first enclosing wall structure. The bottom section may e.g. be flat and may preferably lie flush with the outer surface of the bottom plate. The wall structure preferably extends from the bottom section in axial direction of the lamp unit, preferably at least substantially perpendicular to the outer surface of the bottom section. The wall structure may preferably be closed around the first contact, e.g. providing, in cross-section, a closed structure surrounding the first electrical contact lead to all sides.

According to preferred embodiments of the invention, the cap element comprises at least a first and a second enclosing wall structure. The first enclosing wall structure is preferably arranged to enclose the first contact lead at smaller distance, and the second enclosing wall structure is arranged around the first enclosing wall structure, so as to surround the first contact at a larger distance. Providing a plurality of such wall structures one within the other serves to increase the insulation length. While it is possible to provide at least two enclosing wall structures of the same axial length, it have proven advantageous to provide the first wall structure with a smaller and the second wall structure with a greater axial length. A corresponding cap element may provide sufficient mounting space close to the first contact lead.

According to a further preferred embodiment of the invention, the cap element extends axially into the housing to at least partially surround (in cross-section) a burner tube extending from the burner into the housing. The burner tube is preferably of quartz glass material, and most preferably provided in one piece with the wall of the discharge vessel. A first, central contact lead from the burner is arranged within the burner tube. By surrounding the burner tube with the cap element, suitable insulation is provided.

In configurations where a first, central contact lead and a second, return contact lead from the burner are arranged to protrude into the housing, the cap element is preferably arranged such that at least a part of a wall structure thereof is arranged between the central contact lead and the return contact lead. In particular during ignition, flashover within the lamp cap housing between the contact leads may thus be avoided.

It is further preferred that the cap element has a bottom comprised of a first bottom section (axially) covering the central contact lead and a second bottom section covering the return contact lead. Preferably, the first bottom section is larger than the second bottom section and is arranged centrally, and the second bottom section is arranged directly bordering on the first bottom section.

According to a further preferred embodiment of the invention, the lamp operating circuit provided within the lamp cap housing is arranged on a carrier. The carrier may be e.g. a printed circuit board (PCB), a lead frame or any other suitable arrangement for carrying and interconnecting the electrical components of a circuit. Preferably, an opening may be provided within the carrier, and electrical contact leads from the burner may extend through this opening. In particular, at least the central electrical contact lead from the burner, which may be contained in a burner tube, may extend through the opening. This allows to arrange the burner deep within the lamp cap housing, and thus achieve a very compact arrangement with a reduced light center length (LCL).

According to a preferred embodiment, a carrier, in particular a printed circuit board, is arranged directly on the bottom plate, such that good thermal contact is achieved. In this way, the bottom plate serves effectively as heat sink for electrical components on the carrier. In a particular preferred embodiment, the carrier is a substantially flat printed circuit board sandwiched on the bottom plate.

After assembly, the cap element may be held in place in different ways, such as e.g. by welding, gluing or other fixing measures. In particular, it is preferred to provide within the cavity formed in the lamp cap housing holding structures, shaped and arranged to press against the cap element after insertion, holding it in place by the resulting force. In particular, the holding structures may comprise lamella elements or other shapes, such that during insertion of the cap element into the cavity, the holding structures and/or the cap element is deformed leading to the holding force.

In the lamp cap housing according to the invention, a space for receiving (and preferably means for fixing) a burner, a space for receiving a first contact lead and a space for a lamp operating circuit are provided. A bottom plate is made out of a metal material to dissipate heat. A cap is inserted into an opening in the bottom plate and encloses the mounting space for the first contact lead.

In the manufacturing method according to the invention, a burner is fixed to a lamp cap housing and a lamp operating circuit is provided within the housing. A bottom plate of the housing is made out of a metal material to dissipate heat. A cap is inserted into an opening in the bottom plate and encloses the a first contact lead from the burner.

BRIEF DESCRIPTION OF THE DRAWINGS

The above and other objects, features and advantages of the present invention will become apparent from the following description of a preferred embodiment, in which.

DESCRIPTION OF EMBODIMENTS

Figure 1:
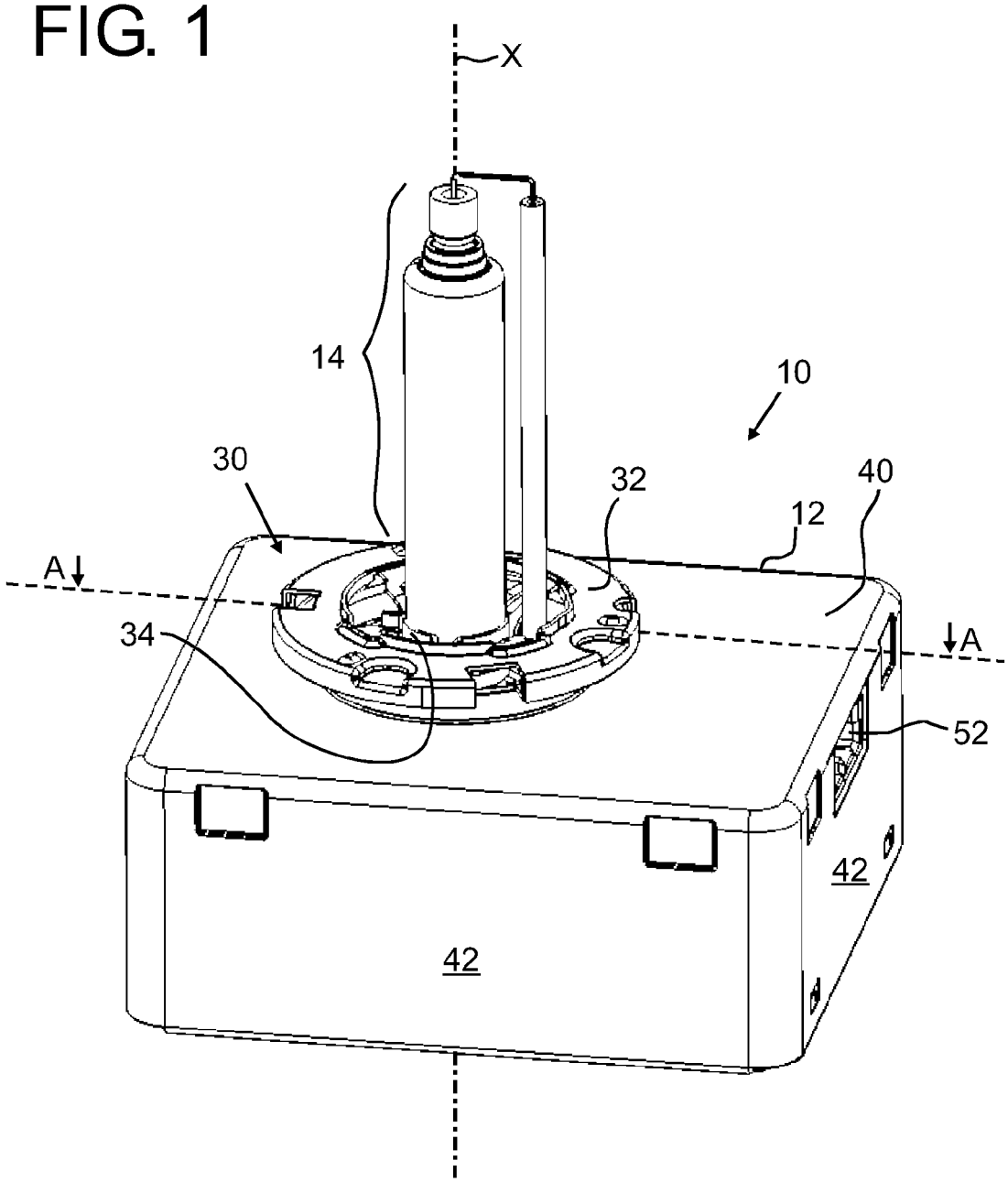
FIG. 1 shows a perspective view of a lamp unit according an embodiment of the invention.

FIG. 1 shows a lamp unit 10 including a lamp cap housing 12, from which a burner 14 protrudes.

Figure 2:
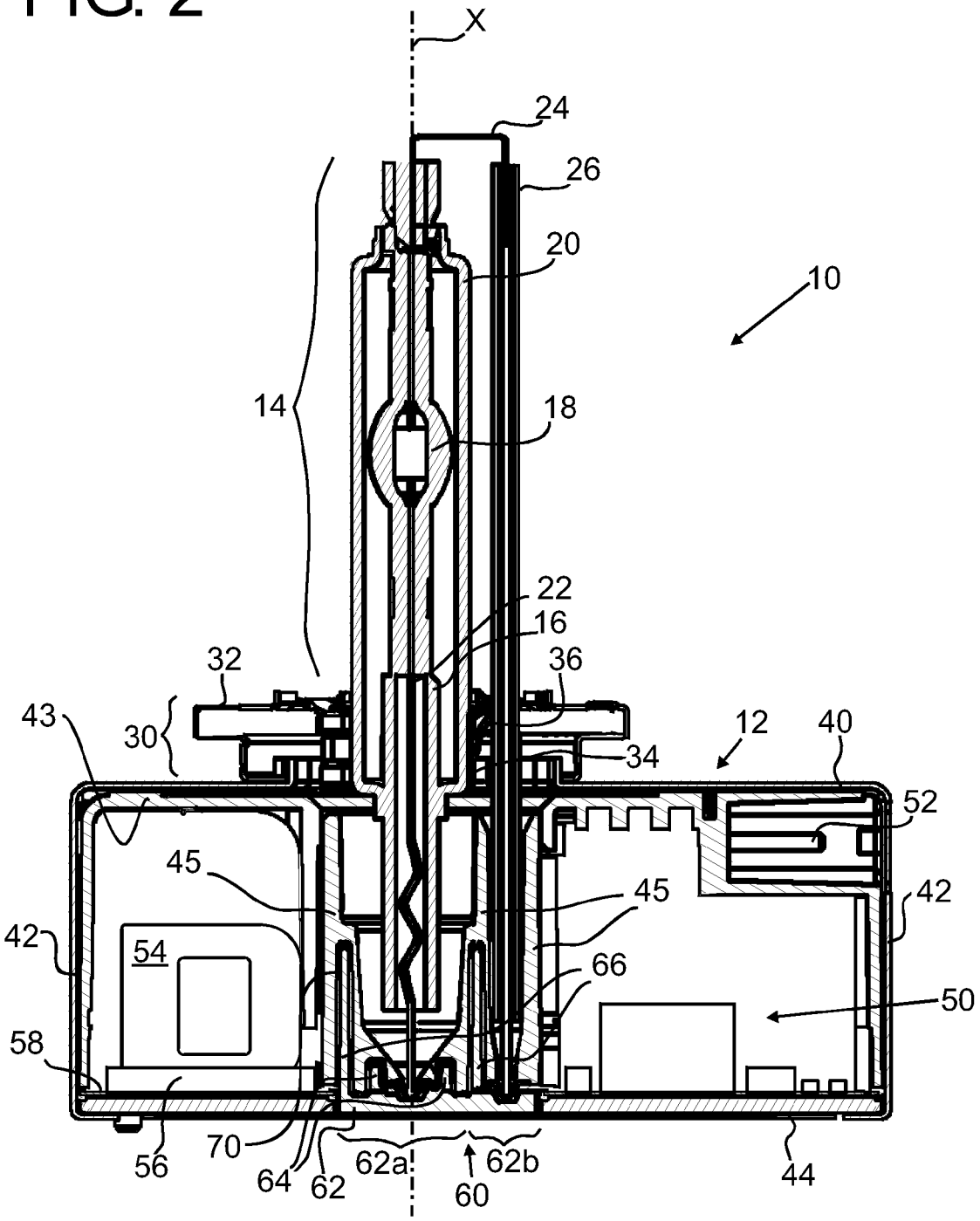
FIG. 2 shows as cross-section of the lamp unit of FIG. 1 along the line A . . . A in FIG. 1.

As visible from the cross-sectional view of FIG. 2, the burner 14 is comprised of a burner tube 16 forming a discharge vessel 18 with an enclosed discharge space and an outer bulb 20 arranged around the discharge vessel 18. The outer bulb 20 and the burner tube 16 with the discharge vessel 18 are made of quartz glass material. Within the discharge space, a first and second electrode are provided. A first electrode which is electrically connected to a first, central contact lead 22 extending within the burner tube 16 into the housing 12. A second electrode is connected to a return contact lead 24 extending in parallel to the longitudinal axis X of the burner 14. A ceramic tube 26 is arranged around the return contact lead 24.

The burner 14 is mechanically held relative to the lamp cap housing 12 by a holding section 30, including a holding ring structure 32 provided around the burner 14, fixed to a collar 34 of the burner 14 by spot-welded spring tongues 36.

The lamp cap housing 12 comprises an upper housing cover 40, side walls 42 and a bottom plate 44 as lower housing cover. All of the housing wall elements 40, 42, 44 are made out of aluminum as a metal material of good heat conduction properties.

Within the lamp cap housing 12, electrical components of a lamp operating circuit 50 are arranged. The lamp operating circuit 50 is supplied with electrical power from an electrical connector 52 opening to the side of the lamp cap housing 12. For use in a motor vehicle headlamp, the lamp unit 10 is electrically connected to onboard electrical power via connector 52. The lamp operating circuit 50 integrated within the lamp cap housing 12 provides all circuitry required to adapt the voltage supplied at connector 52 to the type of electrical driving voltage and current required for the operation of the burner 14 during ignition, following run-up and steady-state operation. The lamp operating circuit 50 comprises on a printed circuit board 58 circuitry for ignition of the lamp such as a transformer 54 as well as a microcontroller 56 for controlling an alternating current to the burner 14.

As visible in particular from the cross-sectional view of FIG. 2, the burner 14 is arranged to protrude quite a distance axially along the axis X into the lamp cap housing 12. The burner tube 16 extends over more than half of the axial length of the lamp cap housing 12. The result of the corresponding arrangement of the burner 14 quite deep within the lamp cap housing 12 leads to a reduced light center length (LCL), i.e. distance between the center of the discharge vessel 18 relative to the holding ring 32 comprising position reference element for relative positioning within a reflector of a motor vehicle headlight unit.

Figure 3:
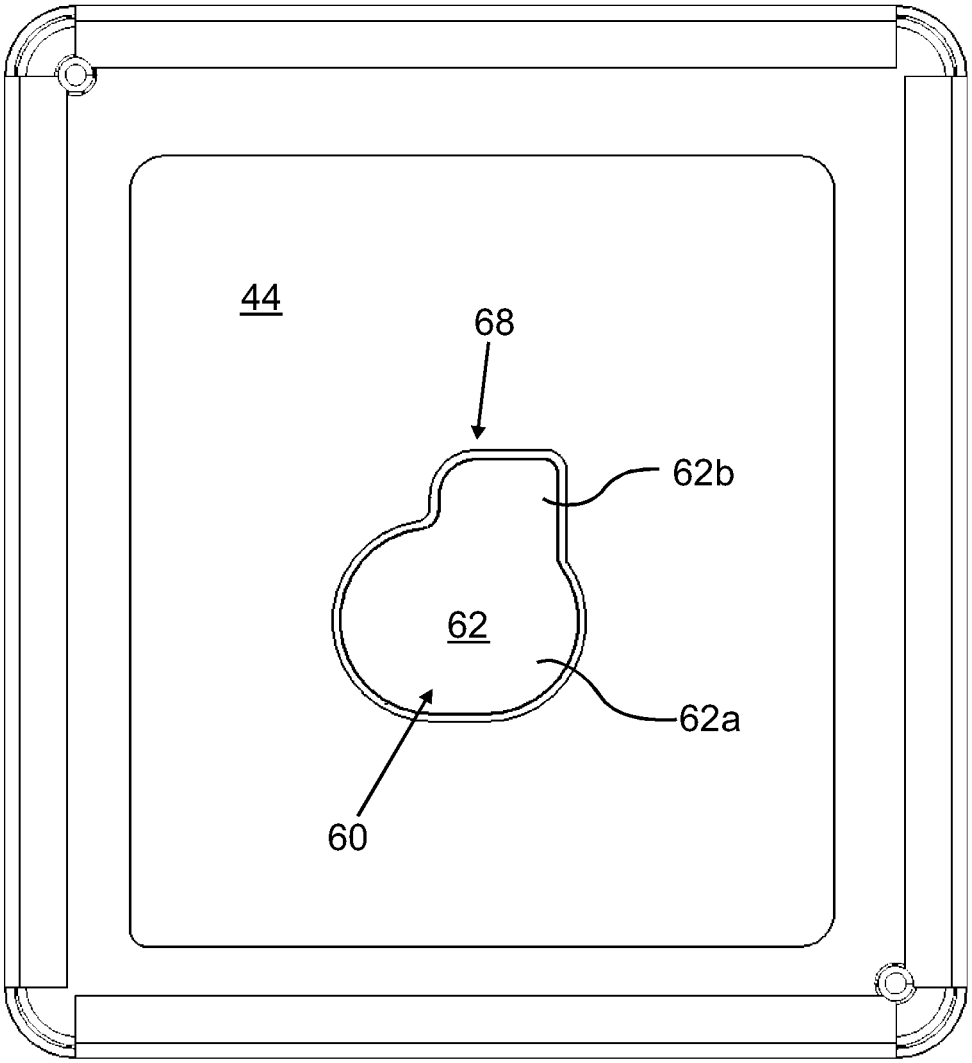
FIG. 3 shows a bottom view of the lamp unit of FIG. 1, FIG. 2.

As the burner 14 is thus installed to protrude into the lamp cap housing 12, the electrical contact leads from the burner 14, namely the central contact lead 22 and return contact lead 24, also extend into the lamp cap housing 12 well more than half of the axial distance, and, in the preferred example shown, even over more than ⅔ of the axial length thereof. In operation of the lamp unit 10, and in particular during ignition, insulation needs to be provided to prevent flashover between the electrical contact leads 22, 24 as well as from any of the contact leads 22, 24 to components or contact leads of the lamp operating circuit 50 or parts of the lamp cap housing 12. In order to provide this insulation, a plastic cap 60 is provided, including a bottom part 62 comprised of a first bottom section 62*a* covering the central contact lead 22 and a second bottom section 62*b* covering the return contact lead 24 axially. As visible in particular from FIG. 3, the first bottom section of the cap 60 is larger and arranged substantially centrally to the longitudinal axis X, whereas the second bottom section 62*b* is smaller and arranged to the side.

The cap 60 comprises a first enclosing wall structure 64 provided directly around the central contact 22, such that the contact 22, seen in a cross-section perpendicular to the longitudinal axis X, is fully enclosed by the wall structure 64. Provided around the first wall structure 64, the cap 60 further comprises a second wall structure 66, which extends axially further than the first enclosing wall structure, up to about half of the longitudinal length of the lamp cap housing 12.

The cap 60 thus serves to provide electrical insulation, in particular between the central contact lead 22 and return contact lead 24, but also between the contact leads 22, 24 and the metal bottom plate 44.

Figure 4:
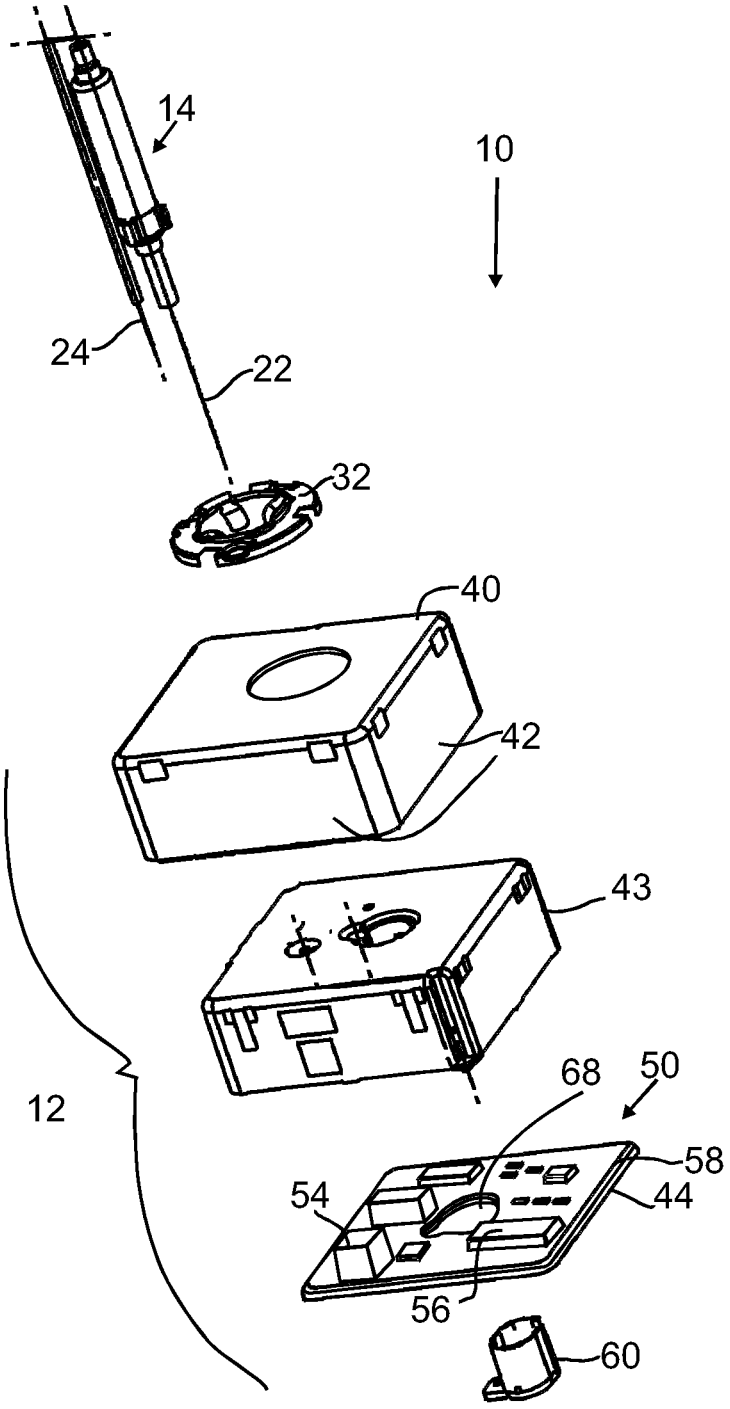
FIG. 4 shows a perspective, exploded view of the lamp unit of FIG. 1-3.

As visible from FIG. 4, the lamp operating circuit 50 is arranged on a printed circuit board 58 provided within the lamp cap housing 12, holding and electrically interconnecting the circuit components. The printed circuit board (PCB) 58 with the electrical components of a lamp operating circuit 50 mounted on a top surface is arranged directly on the bottom plate 44. Thus, there is close thermal contact between the lamp operating circuit 50 and the bottom plate 44, so that the bottom plate 44 serves as heat sink.

An insulating plastic insert 43 is provided within the lamp cap housing 12 to accommodate the connector 52 and to guide and hold the protruding parts of the burner 14 and return contact 24. The insert 43 also comprises vertical plastic walls 45, visible in FIG. 2, forming an opening 68 for the cap 60. The printed circuit board 58 comprises a central opening 68 to accommodate the burner tube 16 with the enclosed central contact lead 22 therein. Thus, the carrier and the components 54, 56 of the lamp operating circuit 50 are arranged around the opening, and—after assembly—arranged around the burner tube 16 extending through the opening. Thus, a very compact arrangement with a short LCL is achieved.

During assembly, as illustrated in FIG. 4, the cap 60 is inserted into the opening 68 provided within the metal bottom cover 44 and the printed circuit board 58.

Within the lamp cap housing 12, the cap 60 is arranged within a cavity, where the wall structures 64, 66 enter into fitting grooves. These grooves provide lamella-shaped holding structures 70. During assembly of the lamp unit 10, the cap 60 is driven into the cavity with force, such that the wall structure 66 and the holding structures 70 deform to thereafter provide a holding force fixing the cap 60 in place.

While the invention has been illustrated and described in detail in the drawings and foregoing description, such illustration and description are to be considered illustrative or exemplary and not restrictive; the invention is not limited to the disclosed embodiments.

For example, different lamp operating circuits may be provided within the lamp cap housing 12. Further, the housing elements of the lamp cap housing 12, which are shown in the embodiment as flat surfaces, may be shaped differently to e.g. comprise heat dissipation structures, such as heat fins etc.

Other variations of the disclosed embodiment can be understood and effected by those skilled in the art in practicing the claimed invention, from a study of the drawings, the disclosure and the appended claims. In the claims, the word "comprising" or "including" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A high-pressure gas discharge lamp unit including a burner with a discharge vessel, said burner comprising an electrical first contact lead and an electrical second contact lead, wherein the first contact lead extends from a bottom of the discharge vessel, and wherein the second contact lead extends from a top of the discharge vessel and is bent downward to be substantially parallel to the first contact lead;

a lamp housing, where said burner protrudes from said housing and is fixed thereto, such that said first contact lead and said second contact lead extend into said housing at least one-half of a height of the housing;

a lamp operating circuit arranged within said housing, electrically connected to said first contact lead and said second contact lead;

a bottom plate, forming part of said housing, made out of a metal material to dissipate heat, where said bottom plate comprises an opening; and an insulating cap element inserted into the opening of said bottom plate, the cap element comprising a first wall structure that fully surrounds the first contact lead extending into the housing, the cap element further comprising a second wall structure that extends further than the first wall structure into the housing and further electrically insulates the second contact lead from the first contact lead.

2. The lamp unit according to claim 1, where said burner comprises an axially arranged burner tube extending into said housing, where a central contact lead is arranged within said burner tube, and where said cap element extends axially into said housing so as to at least partially surround said burner tube.

3. The lamp unit according to claim 1, where said lamp operating circuit comprises electrical components arranged on a carrier, where an opening is provided within said carrier, such that said first contact lead and said second contact lead extend through said opening.

4. The lamp unit according to claim 1, where said lamp operating circuit comprises electrical components arranged on a carrier, where said carrier is arranged directly on said bottom plate.

5. The lamp unit according to claim 1, where said housing comprises a cavity in which said cap element is received, where said cap element is held within said cavity by holding structures pressing against said cap element.

6. A lamp receiving structure for a high-pressure gas discharge lamp unit comprising:

a space for receiving a burner with a discharge vessel and electrical contact leads such that said burner protrudes from said housing, the contact leads comprising a first contact lead and a second contact lead, wherein the first contact lead is substantially parallel to the first contact lead;

a space for receiving said contact leads, such that said contact leads extend into said housing at least one-half a height of said housing;

a space for a lamp operating circuit arranged within said housing to be electrically connected to said electrical contact leads;

a bottom plate made out of a metal material to dissipate heat, where said bottom plate comprises an opening; and an insulating cap element inserted into the opening of said bottom plate, the cap element comprising a first wall structure that fully surrounds the first contact lead, the cap element further comprising a second wall structure that extends further than the first wall structure and further electrically insulates the second contact lead from the first contact lead.

* * * * *